US007620354B2

(12) United States Patent
Shimura et al.

(10) Patent No.: US 7,620,354 B2
(45) Date of Patent: Nov. 17, 2009

(54) IMAGE FORMING APPARATUS INCLUDING FIRST AND SECOND CHARGE REMOVING MEMBERS CONNECTED TO A GROUNDING POINT

(75) Inventors: Masaru Shimura, Numazu (JP); Kenji Kanari, Numazu (JP)

(73) Assignee: Canon Kabushiki Kaisha, Tokyo (JP)

( * ) Notice: Subject to any disclaimer, the term of this patent is extended or adjusted under 35 U.S.C. 154(b) by 46 days.

(21) Appl. No.: 11/067,677

(22) Filed: Mar. 1, 2005

(65) Prior Publication Data

US 2005/0232663 A1 Oct. 20, 2005

(30) Foreign Application Priority Data

Mar. 5, 2004 (JP) ..... 2004-062470

(51) Int. Cl.
*G03G 15/14* (2006.01)

(52) U.S. Cl. ..... 399/315

(58) Field of Classification Search ..... 399/315, 399/302, 308, 313
See application file for complete search history.

(56) References Cited

U.S. PATENT DOCUMENTS

| | | | | |
|---|---|---|---|---|
| 5,153,653 | A | 10/1992 | Fuma et al. | 355/275 |
| 5,495,317 | A | 2/1996 | Matsuda et al. | |
| 5,812,920 | A | 9/1998 | Mizude et al. | 399/316 |
| 6,618,576 | B2 | 9/2003 | Kanari et al. | 399/388 |
| 2003/0063921 | A1 * | 4/2003 | Saito et al. | 399/121 |
| 2003/0219287 | A1 * | 11/2003 | Ogiyama et al. | 399/297 |
| 2005/0058473 | A1 * | 3/2005 | Mizuno et al. | 399/302 |

FOREIGN PATENT DOCUMENTS

| | | | |
|---|---|---|---|
| CN | 1403881 A | | 3/2003 |
| JP | 59104666 A | * | 6/1984 |
| JP | 62134675 A | * | 6/1987 |
| JP | 1-269969 | | 10/1989 |
| JP | 3-186876 A | | 8/1991 |
| JP | 3-228075 | | 10/1991 |
| JP | 5-265335 A | | 10/1993 |
| JP | 06-3971 | | 1/1994 |
| JP | 8-62995 A | | 3/1996 |
| JP | 09-134082 | | 5/1997 |
| JP | 09120216 A | * | 5/1997 |
| JP | 09212003 A | * | 8/1997 |
| JP | 63-83762 | | 4/1998 |
| JP | 10-142961 A | | 5/1998 |

(Continued)

OTHER PUBLICATIONS

Ogiyama et al.; US2003/0219287A1; cited on 892 form mailed Apr. 12, 2006.*

*Primary Examiner*—Quana M Grainger
(74) *Attorney, Agent, or Firm*—Fitzpatrick, Cella, Harper & Scinto

(57) ABSTRACT

An image forming apparatus includes a recording material carrying member which is movable while carrying a recording material, a first charge removing member for removing an electric charge from the recording material carrying member, and a second charge removing member for removing an electric charge from the recording material carrying member. The first and the second charge removing member are electrically connected with each other at a predetermined point where the first and second charge removing members are electrically grounded through an electric element.

4 Claims, 6 Drawing Sheets

FOREIGN PATENT DOCUMENTS

| | | | |
|---|---|---|---|
| JP | 11-237794 | | 8/1999 |
| JP | 2000-105514 | | 4/2000 |
| JP | 2000-284616 | | 10/2000 |
| JP | 2001183916 | A * | 7/2001 |
| JP | 2001-331046 | | 11/2001 |

* cited by examiner

| | TRANSFER FAILURE | IMAGE FAILURE DUE TO ABNORMAL DISCHARGE |
|---|---|---|
| EMB.1 | NO | NO |
| COMP.EMB.1 | YES | NO |
| COMP.EMB.2 | NO | YES |

IMAGE FORMING APPARATUS INCLUDING FIRST AND SECOND CHARGE REMOVING MEMBERS CONNECTED TO A GROUNDING POINT

FIELD OF THE INVENTION AND RELATED ART

The present invention relates to an image forming apparatus, utilizing an electrophotographic recording process, such as a laser printer, a copying machine, a facsimile apparatus, etc.

In an image forming apparatus, using an electrophotographic process, such as a copying machine or a printer, such a transfer step that a toner image as a developer image carried on a photosensitive member as an image bearing member is electrostatically transferred onto a recording material carried on a recording material carrying belt (member) or an intermediary transfer belt (member) by the action of an electric field, has conventionally been performed. For this reason, in the image forming apparatus provided with the recording material carrying belt or the intermediary transfer belt, a voltage application means for applying a voltage, required for the transfer step, to a transfer means is provided. As an example thereof, a contact transfer member connected to a high-voltage power supply is disposed on a back surface of the recording material carrying belt or the intermediary transfer belt at a transfer position thereof.

In the above-described constituted image forming apparatus, the toner image on the photosensitive member is transferred onto the recording material carried on the recording material carrying belt or the intermediary transfer belt by applying thereto a transfer voltage. Particularly, in the case of the recording material carrying belt, a polarity charge is generated on the recording material conveyed to the recording material carrying belt by applying the transfer voltage to electrostatically adsorb the recording material onto the recording material carrying belt. For this reason, while conveying the recording material by the movement of the recording material from the recording material carrying belt by an electrostatic adsorption power. However, in the case where the recording material is adsorbed by the recording material carrying member as described above, the recording material is, after being transferred, required to be separated from the recording material carrying member. For this reason, in the conventional image forming apparatus, a stretching member for a recording material carrying member having a volume resistivity of $10^8$-$10^{14}$ ohm·cm is grounded on a downstream side of a transfer position in a movement direction of the recording material carrying member, whereby electric charges of the recording material carried and conveyed by the recording material carrying member are alleviated or removed to permit separation of the recording material.

Further, in order to prevent image defects (image failure) due to abnormal discharge by removing excessive electric charges located at the back surface of the recording material, a charge removal needle for removing the electric charges from the recording material is disposed in the neighborhood of a downstream position of the recording material in a recording material conveyance direction in some cases.

However, in the above-described conventional image forming apparatuses, in the transfer step, a transfer current generated by a voltage applied to the transfer means considerably flows into a grounding portion through the stretching member or for the intermediary transfer belt or through the charge removal needle disposed on the downstream side of the transfer means, so that it becomes difficult to appropriately transfer the toner image carried on the image bearing member in some cases.

Further, in order to prevent image defect (image failure) due to abnormal discharge by removing excessive electric charges located at the back surface of the recording material, a charge removal needle for removing the electric charges from the recording material is disposed in the neighborhood of a downstream position of the recording material in a recording material conveyance direction in some cases.

However, in the above described conventional image forming apparatuses, in the transfer step, a transfer current generated by a voltage applied to the transfer means considerably flows into a grounding portion through the stretching member for the recording material carrying member or that for the intermediary transfer belt or through the charge removal needle disposed on the downstream side of the transfer means, so that it becomes difficult to appropriately transfer the toner image carried on the image bearing member in some cases.

More specifically, in some cases, a large amount of the transfer current applied to the transfer member in order to transfer the toner image from the photosensitive member as the image bearing member flows into the stretching member or the charge removal needle via the belt member etc. In the case where the image forming apparatus is used in a high temperature/high humidity environment, particularly in the case where a plurality of charge removing members such as charge removal needles are employed, an amount of electric charge can be removed by a charge removing member and then a large amount of electric charge can be removed by another charge removing member. Further, in some cases, when a large amount of electric charge is removed by a charge removing member, an electric charge is not supplied in an amount corresponding to that of electric charge to be removed, so that a resultant transfer current becomes insufficient.

SUMMARY OF THE INVENTION

The present invention has accomplished in view of the above-described problems.

An object of the present invention is to adjust an amount of electric charge removed by an electric charge removing member capable of removing the electric charge from a recording material carrying members or a toner image carrying member.

Another object of the present invention is to provide an image forming apparatus capable of preventing an insufficient transfer current and disorder of toner on a toner image carrying member or a recording material due to discharge or the like, thereby to prevent image defects.

According to an aspect of the present invention, there is provided an image forming apparatus, comprising:

a recording material carrying member which is movable while carrying a recording material, a first charge removing member for removing an electric charge from the recording material carrying member, and a second charge removing member for removing an electric charge from the recording material carrying member, wherein the first charge removing member and the second charge removing member are electrically connected with each other at a predetermined point where the first and second charge removing members are electrically grounded through an electric element.

According to another aspect of the present invention, there is provided an image forming apparatus, comprising:

an image bearing member for bearing an image, a movable toner image carrying member on which a toner image is transferred from the image bearing member and the transferred toner image is carried, a first charge removing member for removing an electric charge from the toner image carrying member, and a second charge removing member for removing an electric charge from the toner image carrying member, wherein the first charge removing member and the second charge removing member are electrically connected with each other at a predetermined point where the first and second chrge removing members are electrically grounded through an electric element.

These and other objects, features and advantages of the present invention will become more apparent upon a consideration of the following description of the preferred embodiments of the present invention taken in conjunction with the accompanying drawings.

DETAILED DESCRIPTION OF THE PREFERRED EMBODIMENTS

Figure 1:
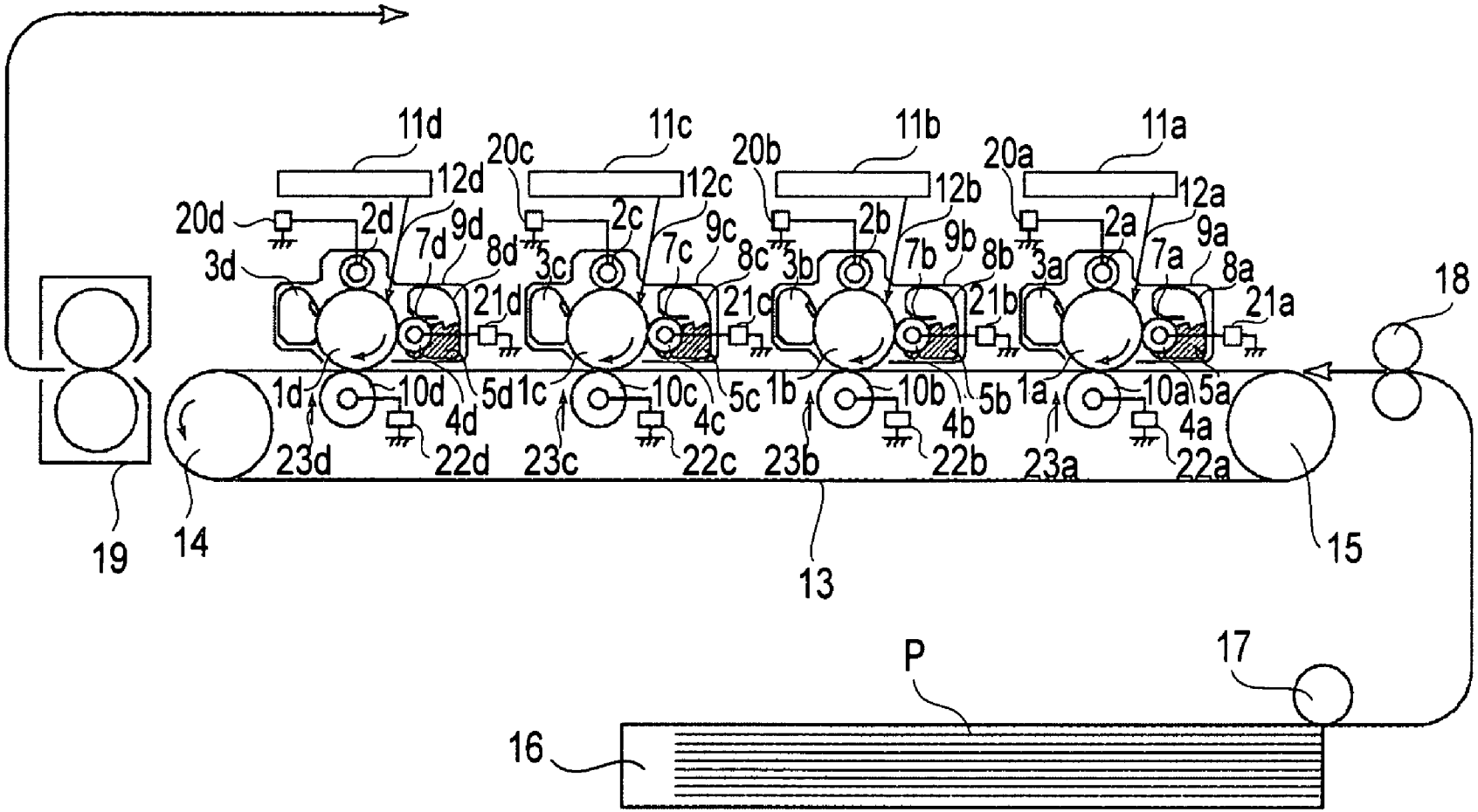
FIG. 1 is a schematic view for illustrating an image forming apparatus according to a First Embodiment of the present invention.

Hereinbelow, the image forming apparatus according to the present invention will be described with reference to the drawings.

First Embodiment

Figure shows a schematic structure of the image forming apparatus according to the present invention.

In this embodiment, a yellow (Y) toner image is formed at a first station, a magenta (M) toner image is formed at a second station, a cyan (C) toner image is formed at a third station, and a black (K) toner image is formed at a fourth station.

At the first station, an integral-type process cartridge 9*a* is constituted by an OPC photosensitive drum 1*a* as an image bearing member; a charge roller 2*a* as a charging means; a cleaning unit 3*a* for cleaning residual toner remaining on the photosensitive drum 1*a*; and a developing unit 8*a*, as a developing means, including a developing sleeve 4*a*, a nonmagnetic one-component developer 5*a*, and a developer application blade 7*a*.

Further, an exposure means 11*a* is constituted by a scanner unit for effecting scanning with laser light through a polygonal mirror, or an LED array, and the surface of the photosensitive drum is irradiated with a scanning beam 12 which is modulated on the basis of an image signal. A transfer belt 13 as a recording material carrying means is extended around a drive roller 14 and a tension roller 15. The drive roller 14 drives the transfer belt 13, and the tension roller 15 applies tension to the transfer belt 13 so that the transfer belt 13 is stably extended around the rollers 14 and 15. The transfer belt 13 is rotated in a direction of an arrow and conveys a recording material P while carrying the recording material P. In such a state that the recording material P is carried on the transfer belt 13, transfer of the toner image onto the recording material P is performed. Further, a transfer roller 10*a* as a contact transfer member is disposed opposite to the photosensitive drum 1*a* through the transfer belt 13, and a charge removal needle 23*a* is disposed on a downstream side of the transfer roller 10*a* in a rotation direction of the transfer belt 13. Further, the charge roller 2*a*, the developing sleeve 4*a*, and the transfer roller 10*a* are connected to a charge bias power supply 20*a* as a voltage supply means for supplying a voltage to the charge roller 2, a developing bias power supply 21*a* as a voltage supply means for supplying a voltage to the developing sleeve 4*a*, and a transfer bias power supply 22*a* as a voltage supply means for supplying a voltage to the transfer roller 10, respectively.

As described above, the first station is constituted. Also, at the second, third and fourth stations, a similar constitution is employed. As reference numerals for the respective members or means at the respective station, those 1*b*-23*b* for the second station, these 1*c*-23*c* for the third station, and those 1*d*-23*d* for the fourth station are used in place of those 1*a*-23*a* for the first station.

Next, an image forming operation will be described.

When the image forming operation is started, the photosensitive drums 1*a*-1*d* and the transfer belt 13 start rotation in directions indicated by respective arrows at a predetermined process speed. The photosensitive drum 1*a* is electrically charged uniformly to have a negative polarity by supplying a voltage from the charge bias power supply 20*a* to the charge roller 2*a*, and then an electrostatic latent image corresponding to image information is formed on the photosensitive drum 1*a* by the scanning beam 12*a* from the exposure means 11*a*.

The toner (developer) 5*a* in the developing unit 8*a* is negatively charged electrically by the developer application blade 7*a* and coated onto the developing sleeve 4*a*. To the developing sleeve 4*a*, a bias voltage is supplied from the developing bias power supply 21*a* and when the electrostatic latent image formed on the photosensitive drum 1*a* reaches the developing sleeve 4*a* by the rotation of the photosensitive drum 1*a*, the electrostatic latent image is visualized with negatively chargeable toner, whereby a first color (yellow (Y) in this embodiment) toner image is formed on the photosensitive drum 1*a*.

On the other hand, the recording material P stacked in a recording material cassette 16 is picked up by a (paper) feeding roller 17 and is fed to a registration roller 18. Then, in synchronism with the toner image on the photosensitive drum 1*a*, the recording material P is conveyed by the registration roller 18.

The recording material P is electrostatically adsorbed by the transfer belt 13 by applying a voltage between the photosensitive drum 1*a* and the transfer roller 10*a* at the first station, and then the toner image on the photosensitive drum 1*a* is transferred onto the recording material P by the transfer roller 10*a* supplied with a positive-polarity transfer bias voltage from the transfer bias power supply 22*c*. Thereafter, in synchronism with the conveyance of the recording material P by the transfer belt 13, formation of the toner images of M, C and K and transfer thereof onto the recording material P are performed at the second, third and fourth stations, respectively. Then, the recording material P onto which the toner images of Y, M, C and K are transferred is separated from the transfer belt 13, and is sent to a fixing apparatus 19 by which the toner images on the recording material P are melted and fixed to provide a color image. Residual toner remaining on the photosensitive drums 1*a* to 1*d* is changed by the cleaning apparatuses 3*a* to 3*d*, such as a fur brush, a blade means, etc.

Figure 2:
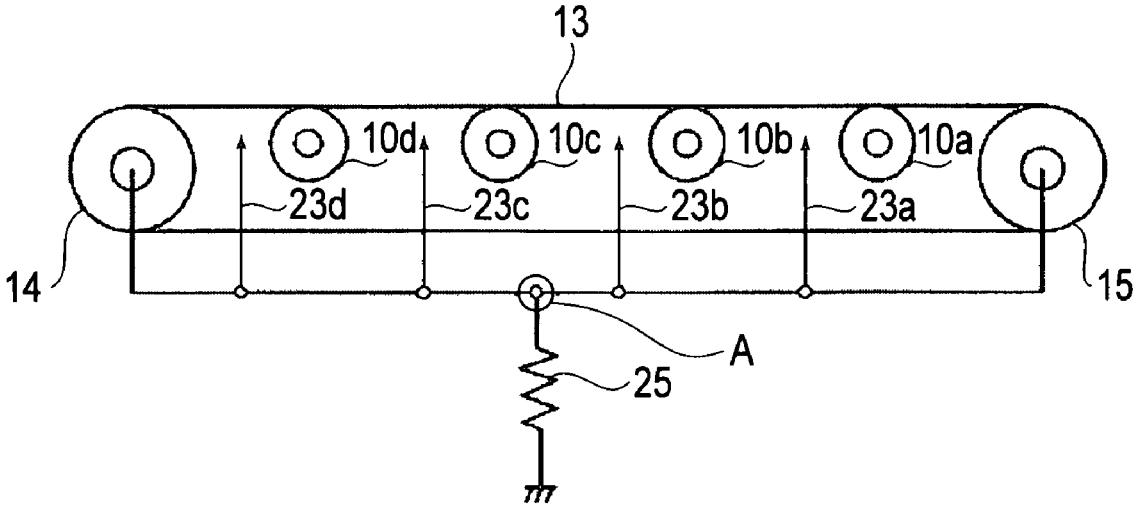
FIG. 2 is a schematic view for illustrating a structure of a transfer belt and the neighborhood thereof in the First Embodiment.

FIG. 2 is a detail view of the transfer belt 13 shown in FIG. 1 and the inside thereof. As shown in FIG. 2, in this embodiment, the drive roller 14, the tension roller 15*m* and the charge removal needles 23*a* to 23*d* are electrically connected with each other and are grounded through a resistor 25.

In the image forming apparatus of this embodiment, inside of the transfer belt 13 as the recording material carrying means, all of the transfer rollers 10*a* to 10*d*, the drive roller 14 as an electric charge removing member, the tension roller 15, and the charge removal needles 23*a* to 23*d* are disposed. These are described below in detail with reference to FIG. 2.

The transfer belt 13 is a 100 μm-thick film of PVDF having a volume resistivity of $10^{11}$ ohm·cm.

The drive roller 14 as the stretching member is a 30 mm-diameter roller comprising an Al core metal coated with a 0.5 mm-thick layer of EPDM rubber which has an electric resistance of $10^4$ ohm and in which carbon black is disposed as an electroconductive agent.

The tension roller 15 as the stretching member is a 30 mm-diameter metal bar formed of Al and provides a tension of 19.6 N for each one side and 39.2 N in total.

The transfer roller 10*a* is a 6 mm-diameter nickel-plated steel bar coated with a 3 mm-thick elastic layer of NBR foam (sponge) and had an electric resistance of $1\times10^8$ ohm when a voltage of 500 V was applied thereto.

Figure 3:
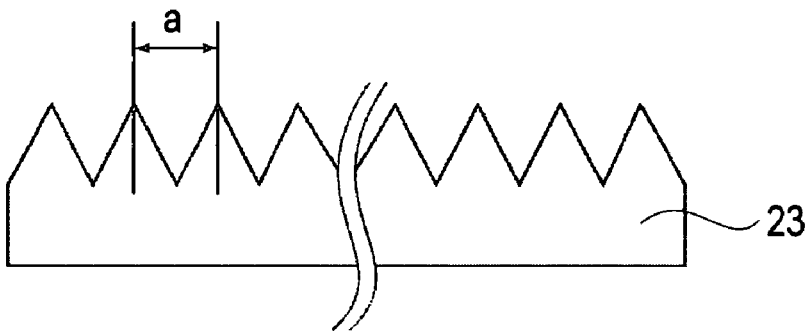
FIG. 3 is a schematic view for explaining a charge removal needle (charge removing member) in the First Embodiment.

The CRN 23*a* at the first station is formed of a 0.1 mm thick SUS member having a pitch of 2.0 mm as shown in FIG. 3. The charge removal needle 23*a* does not contact the transfer belt 13 and has a distance therebetween of 1.5 mm.

Incidentally, at other stations (second to fourth stations), corresponding rollers and charge removal needles have the same constitution as those described above for the first station, and accordingly an explanation thereof will be omitted.

The resistor 25 has a normal rated power of 0.5 W and an electric resistance of 300 M Ω.

Next, an action in this embodiment will be described.

Figures 4, 5:
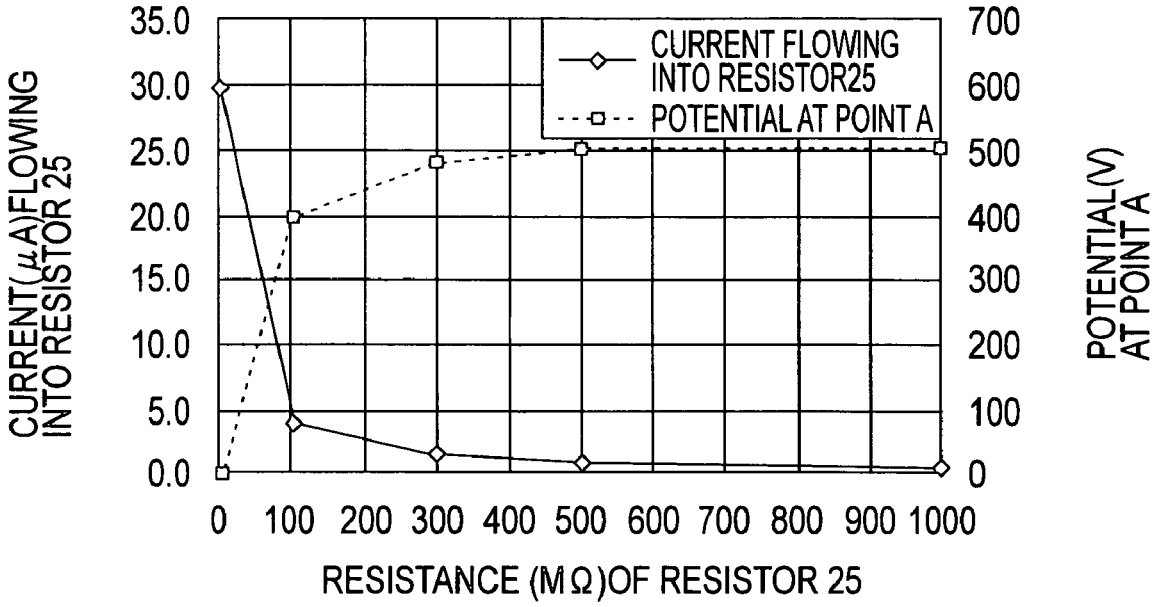
FIG. 4 is a graph showing a relationship between an electric resistance of an electrical resistor 25, an inflow current flowing into the resistor 25, and an electric potential at a point A.
FIG. 5 is a table showing evaluation results in the First Embodiment.

In a high temperature/high humidity environment, the transfer belt 13 and the recording material P take up moisture to lower an electric resistance. When a transfer current which has been applied to the transfer rollers 10*a*-10*d* by the transfer bias power supplies 22*a*-22*d* flows into the drive roller 14, the tension roller 15, and the charge removal needles 23 (23*a*-23*d*), electric potentials of the drive roller 14, the tension roller 15, and the charge removal needles 23 (23*a*-23*d*) are increased. This is because the current flows into the resistor 25 to generate a potential difference between both ends of the resistor 25. Further, potential differences between the respective members and the transfer rollers 10*a*-10*d* become small, so that it is possible to suppress leakage of transfer current. More specifically, FIG. 4 is a graph showing a relationship between an electric resistance of the resistor 25, an inflow current flowing from the members such as the charge removal needles 23*a*-23*d* into the resistor 25, and a potential difference (at a point A shown in FIG. 2) between the resistor 25 and the charge removal needles 23*a*-23*d*. Incidentally, the stretching members (stretching rollers) such as the drive roller 14 and the tension roller 15 and the charge removal needles (members) 23*a*-23*d* function as the electric charge removing member. In this embodiment, the inflow current flowing into the resistor 25 (hereinafter, referred also to as "leakage current") is decreased when the electric resistance of the resistor 25 is increased. Correspondingly, a potential (difference) at the point A between the resistor 25 and the charge removal needles 23*a*-23*d* is also increased. For example, in this embodiment, the inflow current flowing into the resistor 25 is 1.6 μA and a base potential of the stretching members and the charge removal needles as the charge removing members is 480 V. Accordingly, it is possible to ensure a transfer current necessary to transfer the toner image by decreasing the potential difference between the resistor 25 and the transfer rollers 10*a*-10*d* through the inflow current flowing into the resistor 25. As a result, even in the high temperature/high humidity environment, it is possible to obtain an optimum transferability. Particularly, when the current flows into one of the charge removing members, a charge removing ability of other charge removing members is suppressed, so that the transferability is optimized. For example, in the case where the current flows into the tension roller 15, the charge removing ability of the charge removal needles 23*a*-23*d* and the drive roller 14 is suppressed, so that the current supplied from the transfer rollers 10*a*-10*d* effectively functions as a transfer current. In this embodiment, when the electric resistances of the charge removal needles 23*a*-23*d*, the drive roller 14, and the tension roller 15 are lower than that of the resistor 25, electric potentials of charge removing portions of the charge removal needles 23 and the stretching members with respect to the transfer belt 13 can be determined substantially only by the resistor 25. As a result, the electric potentials of these members can be kept at substantially identical levels, thereby to suppress leakage of concentrated current to a predetermined point.

In a low temperature/low humidity environment, an amount of current flowing into the tension roller 15 is small, so that a potential difference between the both ends of the resistor 25 is also small. As a result, the charge removing effect of the charge removal needles 23*a*-23*d* becomes large compared with that in the high temperature/high humidity environment. Accordingly, electric charges which have been excessively charged electrically by the transfer bias voltage can be removed appropriately. As a result, it is possible to suppress abnormal discharge occurring during separation of the recording material P from the photosensitive drums 1*a*-1*d*. This is because an amount of current flowing into the resistor 25 is small, so that it is possible to keep a large potential difference between the charge removal needles 23 and the back surface of the transfer belt 13. As described above, irrespective of environmental conditions such as temperature and humidity, it is possible to ensure an appropriate transferability and suppress image defect (failure) due to abnormal discharge attributable to excessive charge of the transfer belt 13 and the recording material P.

Incidentally, similar effects are also achieved between the tension roller 15 and the charge removal needle 23*a* when only the tension roller 15 and the charge removal needle 23*a* are electrically connected with each other and are grounded via the resistor 25. From the viewpoint of a relationship of flow of electric charge between plural members etc., by electrically connecting two or more charge removing members appropriately, a current flows into one of these charge removing members and a base potential of the other charge removing member (or other charge removing members) is increased to prevent excessive removal of electric charge. For example, in the case where a distance between the tension roller 15 and the charge removal needle 23*a* is shorter than that between the tension roller 15 and the other charge removing members, the above-described constitution becomes a particularly effective means.

<Evaluation of this Embodiment>

In order to confirm the effects of the image forming apparatus of this embodiment, by using a color image forming apparatus having a process speed of 100 mm/sec, the presence/absence of transfer failure in a high temperature/high humidity environment (30° C./80% RH) and image failure (image defect) due to abnormal discharge in a low temperature/low humidity (15° C./10% RH) were evaluated together with two comparative embodiments.

Comparative Embodiment 1

In this comparative embodiment, an image forming apparatus was prepared and evaluated in the same manner as in the First Embodiment except that the charge removal needles 23*a*-23*d* and at least one of the stretching members were not electrically connected and were grounded with no electrical element.

Comparative Embodiment 2

In this comparative embodiment, an image forming apparatus was prepared and evaluated in the same manner as in the First Embodiment except that any one of the drive roller 14, the tension roller 15, and the charge removal needles 23*a*-23*d* was not grounded, i.e., placed in a so-called floating state.

Evaluation Results

Evaluation results of the image forming apparatuses of the First Embodiment (Embodiment 1) and Comparative Embodiments 1 and 2 (Comp. Emb. 1 and 2) are shown in FIG. 5.

For evaluation, sheets of paper in letter size (217 mm×276 mm) were leftstanding for one day in the respective environments and subjected to evaluation of transfer failure and image failure due to abnormal discharge.

As shown in FIG. 5, in the color image forming apparatus of the First Embodiment, both of the transfer failure due to insufficient transfer current and the image failure due to abnormal discharge were not caused to occur.

In the color image forming apparatus of Comparative Embodiment 1, image failure due to abnormal discharge was not caused to occur because charge removal of the transfer belt 13 and the recording material P could be performed sufficiently in the low temperature and low humidity environment. However, in the high temperature/high humidity environment, a total amount of leakage current from the drive roller 14, the tension roller 15, and the charge removal needles 23*a*-23*d* to the grounded portion through the transfer belt 13 and the recording material P became 30 μA. As a result, a transfer current required for transferring the toner image became insufficient to cause transfer failure.

In the color image forming apparatus of Comparative Embodiment 2, sufficient transferability was obtained because there was no current flowing into the drive roller 14, the tension roller 15, and the charge removal needles 23*a*-23*d* through the transfer belt 13 and the recording material P in the high temperature/high humidity environment. However, in the low temperature/low humidity environment, charge removal of the transfer belt 13 and the recording material P could not be performed, so that the transfer belt 13 and the recording material P was charged up (excessively charged electrically). For this reason, after the recording material P passed through the transfer portion, abnormal discharge during the separation of the recording material P from the photosensitive drums 1*a*-1*d* was caused to occur, so that a semicircular abnormal discharge trace was caused to occur on the resultant image.

As described above, on the basis of such a constitution that the charge removal needless 23*a*-23*d* and at least one of the stretching member are electrically connected and grounded via the resistor 25 (electric element), it became possible to ensure an appropriate transferability and suppress image failure due to abnormal discharge resulting from excessive charge of the transfer belt 13 and the recording material P, irrespective of environmental conditions such as temperature and humidity.

Second Embodiment

Figure 6:
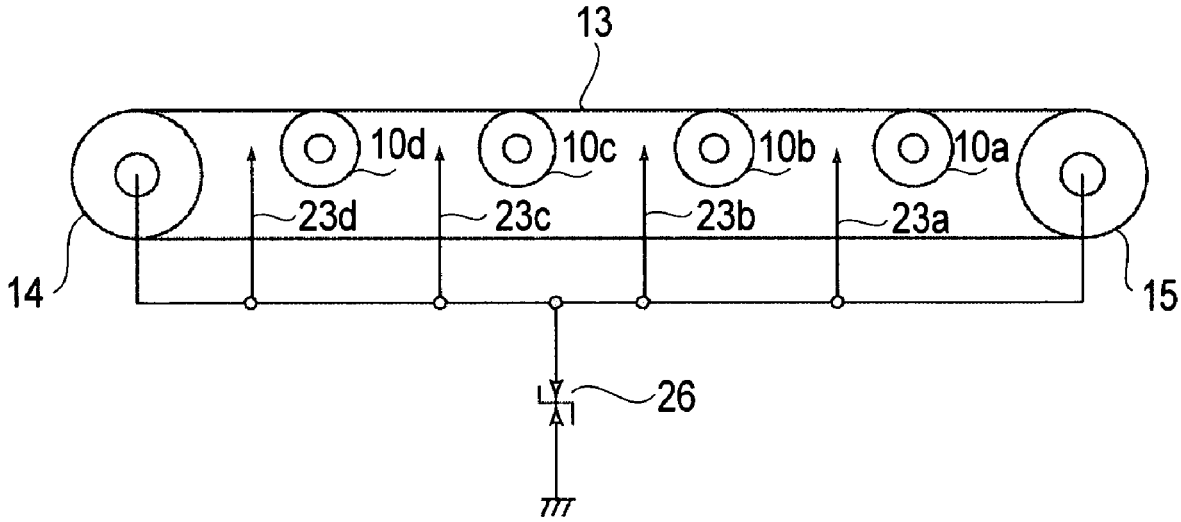
FIG. 6 is a schematic view for illustrating a structure of a transfer belt and the neighborhood thereof in a Second Embodiment of the present invention.

In this embodiment, an image forming apparatus is prepared in the same manner as in the First Embodiment except that all the charge removing members consisting of the drive roller 14, the tension roller 15, and the charge removal needles 23*a*-23*d* are electrically connected with each other and grounded through a constant-voltage element 26 as shown in FIG. 6 (instead of the resistor 25 shown in FIG. 5 in the First Embodiment).

As the constant-voltage element 26, it is possible to use a varistor, a zener diode, etc., which have a voltage in the range of 50 V to 1 kV. In this embodiment, a varistor having a varistor voltage of 500 V is used.

The drive roller 14, the tension roller 15, and the charge removal needles 23*a*-23*d* are grounded through the varistor 26.

Next, an action in this embodiment will be described.

In the high temperature/high humidity environment, the transfer belt 13 and the recording material P take up moisture to lower an electrical resistance. When a transfer bias which has been applied to the transfer rollers 10*a*-10*d* through the transfer belt 13 and the recording material P flows into the drive roller 14, the tension roller 15, and the charge removal needles 23*a*-23*d*, base electric potentials of the drive roller 14, the tension roller 25, and the charge removal needles 23*a*-23*d* are increased. This is because the current flows into the varistor 26 to generate a potential difference, as a varistor potential (500 V), between both ends of the varistor 26. For this reason, potential differences between the respective charge removing members and the transfer rollers 10*a*-10*d* become small, so that it is possible to suppress flowing of the transfer current into the charge removing members. Further, in the low temperature/low humidity environment, it is possible to keep the electric potentials of the drive roller 14 and the tension roller 15 which directly contact the transfer belt 13 at low levels, so that an electric potential at the back surface of the transfer belt 13 can be kept at a level which is not more than a predetermined value. For this reason, it is possible to alleviate electric charge excessively charged by the transfer bias to suppress abnormal discharge generated during separation of the recording material P from the transfer belt 13.

As described above, according to the present invention, it becomes possible to ensure an appropriate transferability and suppress image failure due to abnormal discharge attributable to excessive charge of the transfer belt 13 and the recording material P, irrespective of environmental conditions such as temperature and humidity.

In this embodiment, the base electric potentials of the drive roller 14, the tension roller 15, and the charge removal needles 23*a*-23*d* do not exceed a certain value by the action of the varistor 26, so that when the recording material P is electrically charged to have excessive electric charge, a charge removal efficiency of the charge removal needles 23 is increased compared with that in the First Embodiment. As a result, an abnormal discharge suppressing ability is also enhanced.

Third Embodiment

Figure 7:
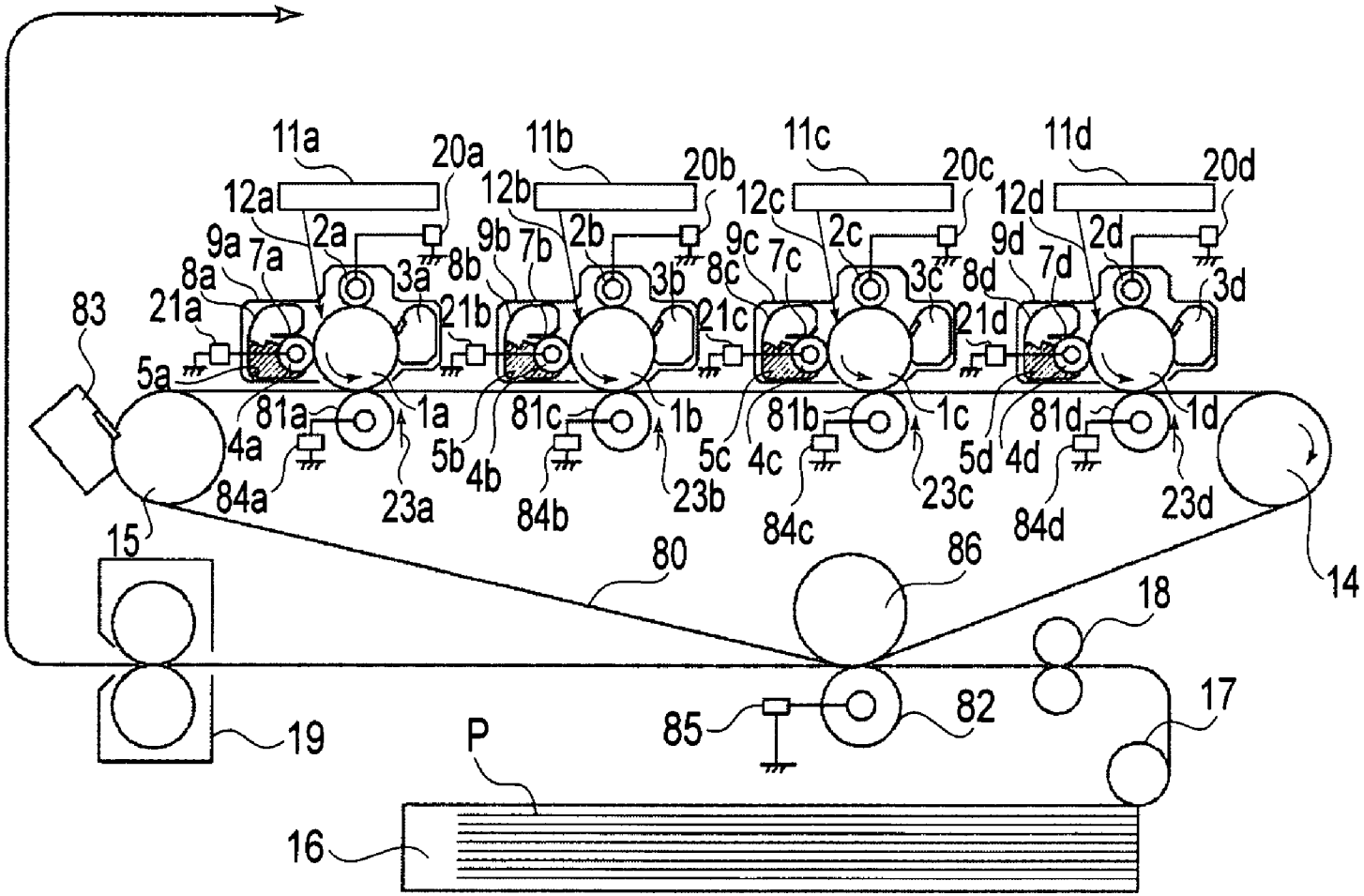
FIG. 7 is a schematic view for illustrating an image forming apparatus according to a Third Embodiment of the present invention.

An image forming apparatus using an intermediary transfer belt will be described with reference to FIG. 7.

Hereinbelow, an image forming operation will be described in detail.

All the actions (functions), in an image forming process, of photosensitive drums 1*a*-1*d*, charge rollers 2*a*-2*d* as charging means, exposure means 11*a*-11*d*, developing apparatuses 8*a*-8*d*, and cleaning means 3*a*-3*d* for the photosensitive drums 1*a*-1*d* used in this embodiment are similar to those in the First Embodiment described above. On the surfaces of the photosensitive drums 1*a*-1*d*, toner images are formed as described above specifically.

On the other hand, an intermediary transfer belt 80 as a toner image carrying member is disposed so as to contact all the photosensitive drums 1*a*-1*d*.

The intermediary transfer belt 80 is supported by three rollers, as stretching members, including a secondary-transfer opposite roller 86, a drive roller 14, and a tension roller 15, thus being held under appropriate tension. The intermediary transfer belt 80 is moved in a forward direction with respect to a rotation direction of the photosensitive drums 1*a*-1*d* at a speed substantially identical to that of the photosensitive drums 1*a*-1*d* by driving the drive roller 14. Further, the intermediary transfer belt 80 is rotated in a direction of an arrow (indicated in the drive roller 14). A primary transfer roller 81*a* is disposed opposite to the photosensitive drum 1*a* through the intermediary transfer belt 80, and a charge removal needle 23*a* is disposed downstream from the primary transfer roller 81*a* in the rotation direction of the intermediary transfer belt 80.

Further, the charge roller 2*a*, a developing sleeve 4*a*, and the primary transfer roller 81*a* are connected to a charging bias power supply 20*a* as a voltage application means for the charge roller 2*a*, a developing bias power supply 21*a* as a voltage application means for the developing sleeve 4*a*, and a primary transfer bias power supply 84*a* as a voltage application means for the primary transfer roller 81*a*, respectively. Further, a secondary transfer roller 82 is connected to a secondary transfer bias power source 85.

Around the intermediary transfer belt 80, the primary transfer rollers 81*a* are disposed opposite to the photosensitive drums 1*a*-1*d*, respectively.

Depending on a distance between respective primary transfer positions for respective colors, for each color, an electrostatic latent image is formed on each of the photosensitive drums 1*a*-1*d* by exposure while delaying a writing signal from a controller at a certain timing. Then, to each of the primary transfer rollers 81*a*-81*d*, an appropriate DC bias voltage of a polarity opposite to a charge polarity of toner is applied. Through the above-described steps, toner images are successively transferred onto the intermediary transfer belt 80 to form a multiple (superposed) image on the intermediary transfer belt 80.

Thereafter, in synchronism with image formation of the electrostatic latent image by exposure, a recording material P stacked in a recording material cassette 16 is picked up by a feeding roller 17 and fed to registration rollers 18 by conveyance rollers (not shown), and is further conveyed by the registration roller to an abutment portion formed between the intermediary transfer belt 80 and the secondary transfer roller 82. Then, to the secondary transfer roller 82, a bias voltage opposite in polarity to the toner is applied by the secondary transfer bias power supply 85, so that the multi-color (four-color) toner images carried on the intermediary transfer belt 80 are simultaneously secondary-transferred onto the recording material P.

Incidentally, the secondary transfer roller 82 is formed of a core metal coated with an elastic member of EPDM which has been adjusted to have a volume resistivity of $10^8$ ohm·cm. The secondary transfer roller 82 is pressed against the intermediary transfer belt at a linear pressure of approximately 5-15 g/cm so as to be rotated in a forward direction with respect to the movement direction of the intermediary transfer belt 80 at a speed substantially identical to that of the intermediary transfer belt 80.

On the other hand, after the second transfer is completed, transfer residual toner remaining on the intermediary transfer belt 80 and paper dust generated by conveyance of the recording material P are removed and recovered from the surface of the intermediary transfer belt 80 by a belt cleaning means 83 disposed in contact with the intermediary transfer belt 80. Incidentally, in the image forming apparatus in this embodiment, an elastic cleaning blade formed of an urethane rubber or the like is used as the belt cleaning means 83.

The recording material P after the completion of secondary transfer is conveyed to a fixing means 19 where the toner image is subjected to fixation and is discharged outside the image forming apparatus as an image formation product (print or copy).

Figure 8:
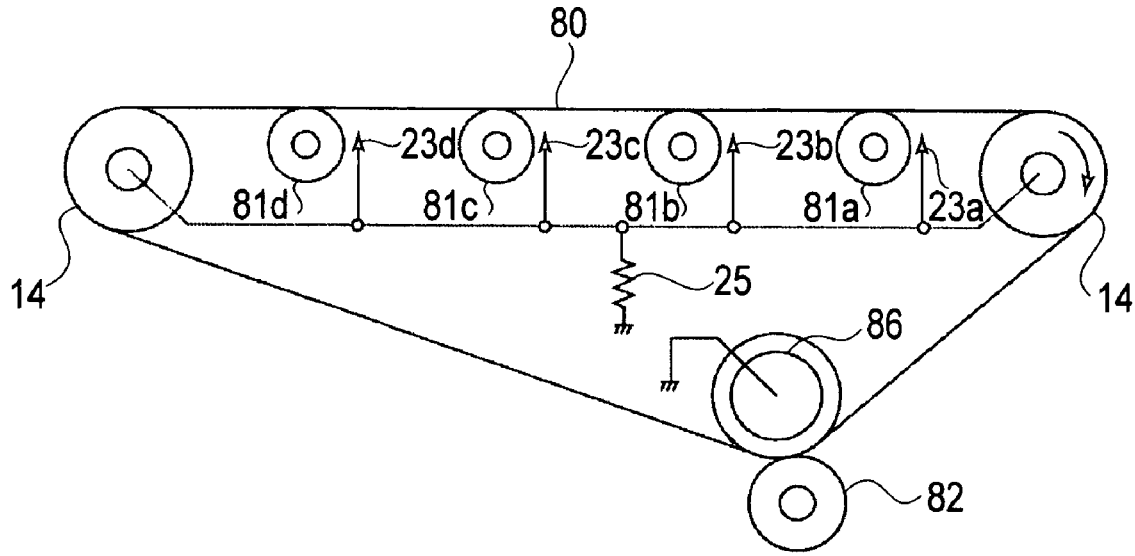
FIG. 8 is a schematic view for illustrating a structure of an intermediary transfer belt and the neighborhood thereof in the Third Embodiment.

In this embodiment, as shown in FIG. 8, all the drive roller 14, the tension roller 15, and the charge removal needles 23*a*-23*d* are electrically connected with each other and are grounded through a resistor 25, and a secondary-transfer opposite roller 86 is directly grounded.

The intermediary transfer belt 80 is constituted by a 100 μm-thick film of PVDF having a volume resistivity of $10^{11}$ ohm·cm.

The drive roller 14 as the stretching member is a 30 mm-diameter roller comprising an Al core metal coated with a 0.5 mm-thick layer of EPDM rubber which has an electric resistance of $10^4$ ohm and in which carbon black is disposed as an electroconductive agent.

The tension roller 15 as the stretching member is a 30 mm-diameter metal bar formed of Al and provides a tension of 19.6 N for each one side and 39.2 N in total.

The primary transfer roller 81*a* is a 6 mm-diameter nickel-plated steel bar coated with a 4 mm-thick elastic layer of NBR foam (sponge) and had an electric resistance of $4\times10^8$ ohm of an absolute moisture of 1 g/m$^3$ and an electric resistance of $2.5\times10^7$ ohm at an absolute moisture of 25 g/m$^3$, when a voltage of 500 V was applied thereto.

The CRN 23*a* at the first station is formed of a 0.1 mm thick SUS member having a pitch of 2.0 mm similarly as in the First Embodiment. The charge removal needle 23*a* does not contact the intermediary transfer belt 80 and has a distance therebetween of 1.5 mm.

Incidentally, at other stations (second to fourth stations), corresponding rollers and charge removal needles have the same constitution as those described above for the first station, and accordingly explanation thereof will be omitted.

The resistor 25 has a normal rated power of 0.5 W and an electric resistance of 300 MΩ similarly as in the First Embodiment.

Next, an action in this embodiment will be described.

In a high temperature/high humidity environment, the intermediary transfer belt 70 and the recording material P take up moisture to lower an electric resistance. When a transfer current which has been applied to each of the primary transfer rollers 71*a*-71*d* by the primary transfer bias power supplies 22*a*-22*d* flows into a part of the drive roller 14 for stretching the intermediary transfer belt 80, the tension roller 15 for stretching the intermediary transfer belt 80, and the charge removal needles 23 (23*a*-23*d*), all base electric potentials of the drive roller 14, the tension roller 15, and the charge removal needles 23*a*-23*d* are increased. For this reason, potential differences between the respective members and the primary transfer rollers 81*a*-81*d* become small, so that leakage of transfer current can be suppressed. By suppressing the leakage of transfer current, it is possible to ensure a transfer current necessary to transfer the toner image and obtain an optimum transferability even in the high temperature/high humidity environment. Further, in the low temperature/low humidity environment, surface electric charges of the intermediary transfer belt 80 are removed by the charge removal needles 23*a*-23*d* to alleviate electric charges excessively charged by the transfer bias voltage, whereby it is possible to suppress abnormal discharge generated during separation of the recording material P from the photosensitive drums.

Incidentally, similarly as in the Second Embodiment, a similar effect can be achieved by grounding the constant-voltage element instead of the resistor 25.

Fourth Embodiment

Figure 9:
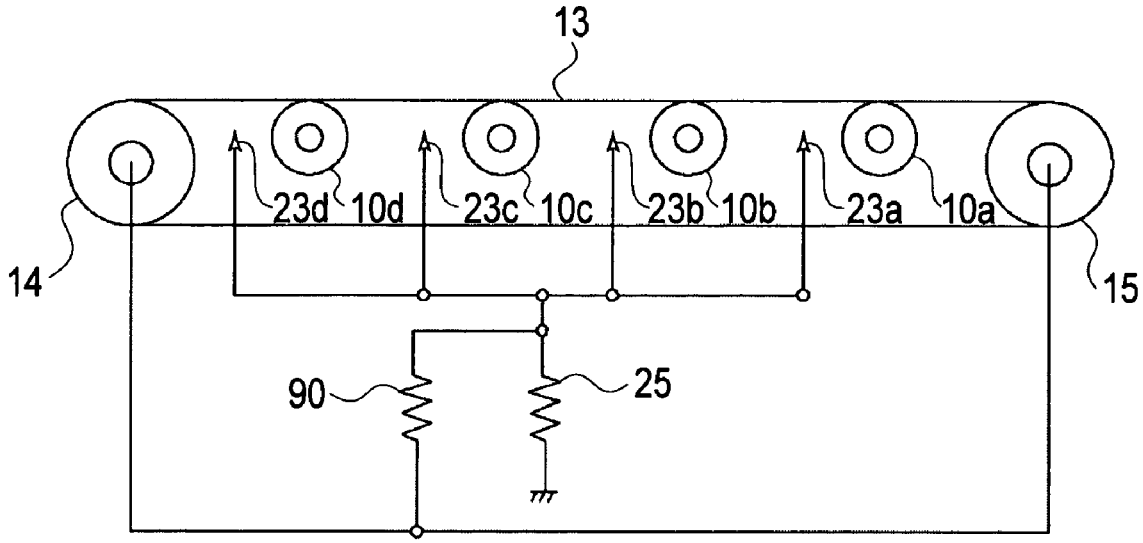
FIG. 9 is a schematic view for illustrating a structure of a transfer belt and the neighborhood thereof in a Fourth Embodiment of the present invention.

In this embodiment, an image forming apparatus is prepared in the same manner as in the First Embodiment except that the drive roller 14 and the tension roller 15 are once electrically connected with each other and then electrically connected with the charge removal needles (charge removal needles 23*a*-23*d* through a resistor 90 and grounded through the resistor 25 from a connecting point between the resistor 90 and the charge removing needles 23*a*-23*d* shown in FIG. 9. Each of the resistors 25 and 90 has a rated power of 0.5 W and an electric resistance of 300 MΩ.

Next, an action in this embodiment will be described.

In the high temperature/high humidity environment, the transfer belt 13 and the recording material P take up moisture to lower an electrical resistance. A transfer current flows into the drive roller 14 for stretching the transfer belt 13, the tension roller 15 for stretching the transfer belt 13, and the charge removal needles 23*a*-23*d*. However, in this embodiment, base electric potentials of the drive roller 14, the tension roller 25, and the charge removal needles 23*a*-23*d* are increased due to the presence of the resistors 25 and 90, thus suppressing the inflow transfer current. Particularly, in this embodiment, by the action of the resistor 90, it is possible to further effectively suppress the leakage current flowing into the drive roller 14 and the tension roller 15 in the high temperature/high humidity environment. In the low temperature/low humidity environment, base electric potentials of the drive roller 14 and the tension roller 15 which directly contact the transfer belt 13 can be kept at levels higher than those of the charge removal needles 23*a*-23*d*, so that it is possible to particularly suppress the flowing of current into the drive roller 14 and the tension roller 15. On the other hand, when an amount of current flowing into the drive roller 14 and the tension roller 15 is small, electric charges excessively charged by the drive roller 14 and the tension roller 15 can be alleviated, thus suppressing abnormal discharge generated during separation of the recording material P from the transfer belt 13. As described above, according to the present invention, it is possible to set the base electric potentials of the drive roller 14, the tension roller 15, and the charge removal needles 23*a*-23*d* so that those of the drive roller 14 and the tension roller 15 are different from those of the charge removal needles 23*a*-23*d*.

As described above, by electrically connecting the drive roller 14 and the tension roller 15 with the charge removal needles 23*a*-23*d* via the electric element and then grounding them via another electric element, it becomes possible to suppress image failure due to abnormal discharge attributable to excessive charge of the transfer belt 13 and the recording material P while ensuring a transferability irrespective of environmental conditions such as temperature and humidity and ensuring a charge removal efficiency of the charge removal needles (charge removing members). Incidentally, the image forming apparatus of this embodiment may also be modified and applied to the system utilizing the intermediary transfer belt 80 as in the Third Embodiment.

The image forming apparatus according to the present invention is not restricted to those described in the above-mentioned embodiments but may be similarly applicable to those using an intermediary transfer drum or a transfer drum as the transfer means. Further, in the case where the intermediary transfer member is utilized as the transfer means, the above-described constitution may also be applicable to a secondary transfer portion. These applied embodiments may also be applicable to the system using the intermediary transfer belt 80 as in the Third Embodiment.

While the invention has been described with reference to the structures disclosed herein, it is not confined to the details set forth and this application is intended to cover such modifications or changes as may come within the purposes of the improvements or the scope of the following claims.

This application claims priority from Japanese Patent Application No. 062470/2004 filed Mar. 5, 2004, which is hereby incorporated by reference.

What is claimed is:

1. An image forming apparatus, comprising:

a plurality of image bearing members for bearing a toner image;

a movable belt member adapted to carry a recording material;

a plurality of transfer members for supplying an electric charge to a plurality of transfer areas of said belt member, to transfer the toner image from respective ones of said image bearing members onto the recording material;

a plurality of charge removal needles for removing the electric charge from said belt member, wherein said plurality of charge removal needles are positioned at downstream sides from associated ones of said plurality of transfer members with respect to a conveyance direction of the recording material;

a first stretching member for stretching said belt member and removing the electric charge from said belt member; and a second stretching member for stretching said belt member and removing the electric charge from said belt member, wherein the recording material is separated from said belt member at a position in which said belt member is stretched by said second stretching member, wherein said plurality of transfer members and said plurality of charge removal needles are disposed between said first stretching member and said second stretching member, and wherein each of said plurality of charge removal needles and each of said first and second stretching members are electrically coupled to a predetermined point of electric potential and said predetermined point of electric potential is electrically coupled to ground through a single resistor.

2. The image forming apparatus according to claim 1, said first and second stretching members are electrically coupled, to said predetermined point of electric potential and said first resistor, through another resistor.

3. The image forming apparatus according to claim 1, wherein said belt member has an annular shape and is adapted to carry the recording material on an outer surface thereof, and said plurality of charge removal needles and said first and second stretching members are disposed on an inner surface of said belt member.

4. An image forming apparatus, comprising:

a plurality of image bearing members for bearing a toner image;

a movable belt member adapted to carry a recording material;

a plurality of transfer members for supplying an electric charge to a plurality of transfer areas of said belt member, to transfer the toner image from respective ones of said image bearing members onto the recording material;

a plurality of charge removal needles for removing the electric charge from said belt member, wherein said plurality of charge removal needles are positioned at downstream sides of associated ones of said plurality of transfer members, with respect to a conveyance direction of the recording material;

a first stretching member for stretching said belt member and removing the electric charge from said belt member; and a second stretching member for stretching said belt member and removing the electric charge from said belt member, wherein the recording material is separated from said belt member at a position in which said belt member is stretched by said second stretching member, wherein said plurality of transfer members and said plurality of charge removal needles are disposed between said first stretching member and said second stretching member, and wherein each of said plurality of charge removal needles and each of said first and second stretching members are electrically coupled to a predetermined point of electric potential, and said predetermined point of electric potential is electrically coupled to ground through a single varistor.

* * * * *